US009728919B1

(12) United States Patent
Dunwoody et al.

(10) Patent No.: US 9,728,919 B1
(45) Date of Patent: Aug. 8, 2017

(54) RECEPTACLE ASSEMBLY FOR A PLUGGABLE MODULE AND A COMMUNICATION SYSTEM HAVING THE SAME

(71) Applicant: TYCO ELECTRONICS CORPORATION, Berwyn, PA (US)

(72) Inventors: Steven David Dunwoody, Middletown, PA (US); Alex Michael Sharf, Harrisburg, PA (US); Richard James Long, Columbia, PA (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 0 days.

(21) Appl. No.: 15/212,606

(22) Filed: Jul. 18, 2016

(51) Int. Cl.
*H01R 13/648* (2006.01)
*H01R 25/00* (2006.01)
*H01R 13/658* (2011.01)

(52) U.S. Cl.
CPC ..... *H01R 25/006* (2013.01); *H01R 13/658* (2013.01)

(58) Field of Classification Search
CPC ..... H01R 14/6599
USPC ..... 439/607.2, 607.21
See application file for complete search history.

(56) References Cited

U.S. PATENT DOCUMENTS

| | | | | |
|---|---|---|---|---|
| 8,890,004 | B2 | 11/2014 | Wickes et al. | |
| 9,413,115 | B1 * | 8/2016 | Henry | H05K 9/0016 |
| 2007/0167077 | A1 * | 7/2007 | Mizue | G02B 6/4201 439/607.01 |
| 2010/0151733 | A1 * | 6/2010 | Tsou | H01R 23/6873 439/607.55 |

* cited by examiner

*Primary Examiner* — Phuong Dinh

(57) ABSTRACT

Receptacle assembly includes a receptacle cage having an interior cavity forming first and second module passages. The first and second module passages are configured to receive respective pluggable modules through first and second port openings, respectively, in a loading direction that is parallel to a Z-axis. The receptacle assembly also includes a cage cover positioned at the front end between the first and second port openings. The cage cover includes first and second module fingers. The cage cover also including a ground tab that engages an inner surface of the receptacle cage. The first and second module fingers extend lengthwise in the loading direction. The ground tab extends lengthwise along a Y-axis that is perpendicular to the Z-axis.

20 Claims, 5 Drawing Sheets

RECEPTACLE ASSEMBLY FOR A PLUGGABLE MODULE AND A COMMUNICATION SYSTEM HAVING THE SAME

BACKGROUND

The subject matter herein relates generally to receptacle assemblies configured to receive pluggable modules in a communication system.

Communication systems exist today that utilize plug and receptacle assemblies to transmit data. Network systems, servers, data centers, and the like may use plug and receptacle assemblies to interconnect the various devices of the communication system. A plug and receptacle assembly includes a cable assembly having a pluggable module and a receptacle assembly having a receptacle cage and an electrical connector disposed within the receptacle cage. The receptacle assembly is configured to receive the pluggable module and communicatively couple to the pluggable module with the electrical connector within the receptacle cage. The receptacle cage is designed to impede electromagnetic interference (EMI) leakage.

The receptacle assemblies and pluggable modules may be configured to transfer data signals in accordance with industry standards. Known industry standards for receptacle assemblies and pluggable modules include small-form factor pluggable (SFP), enhanced SFP (SFP+), quad SFP (QSFP), enhanced QSFP (QSFP+), high speed QSFP (or zQSFP), enhanced zQSFP (zQSFP+), C form-factor pluggable (CFP), and 10 Gigabit SFP, which is often referred to as XFP. The receptacle assemblies and pluggable modules may be capable of implementing one or more communication protocols. Non-limiting examples of communication protocols that may be implemented include Ethernet, Fibre Channel, InfiniBand, and Synchronous Optical Networking (SONET)/Synchronous Digital Hierarchy (SDH).

It is often necessary for developers to modify the physical design of the receptacle assembly and/or the pluggable module in order to achieve a desired data rate, certain space requirements, a desired thermal energy transfer path or level, and/or other objectives. When the physical design of the receptacle assembly changes, however, EMI leakage may develop at unpredictable locations of the receptacle assembly.

Accordingly, there is a need for an alternative receptacle assembly that effectively reduces EMI leakage.

BRIEF DESCRIPTION

In an embodiment, a receptacle assembly is provided that includes a receptacle cage having an interior cavity and first and second partition walls disposed in the interior cavity that separate the interior cavity into first and second module passages, respectively. The first and second module passages have first and second port openings, respectively, at a front end of the receptacle cage. The first and second module passages are configured to receive respective pluggable modules through the first and second port openings in a loading direction that is parallel to a Z-axis. The receptacle assembly also includes a cage cover positioned at the front end between the first and second port openings. The cage cover includes first and second module fingers. The cage cover also including a ground tab that engages an inner surface of the receptacle cage. The first and second module fingers extend lengthwise in the loading direction. The ground tab extends lengthwise along a Y-axis that is perpendicular to the Z-axis.

In some embodiments, the cage cover also includes a side tab that extends lengthwise in the loading direction. The side tab engages the inner surface of the receptacle cage.

In some aspects, the ground tab engages the inner surface of the receptacle cage along a first engagement zone, and the side tab engages the inner surface of the receptacle cage along a second engagement zone. The first and second engagement zones have different elevations measured along the Z-axis.

In some aspects, the ground tab engages the inner surface of the receptacle cage along a first engagement zone, and the side tab engages the inner surface of the receptacle cage along a second engagement zone. The first and second engagement zones may be linear engagement zones that extend lengthwise in perpendicular directions. Optionally, the first and second engagement zones have a T-shaped relationship.

The first and second module fingers are configured to engage the respective pluggable modules along corresponding engagement zones. In some aspects, the corresponding engagement zones of the first and second module fingers are located deeper into the interior cavity with respect to the front end than the engagement zone of the ground tab.

In some embodiments, the cage cover includes a base structure having a face plate that faces an exterior of the receptacle assembly. The first and second module fingers are coupled to and configured to flex with respect to the base structure. Optionally, the base structure includes a passage panel that is coupled to and oriented perpendicular to the face plate. The passage panel partially defines the first module passage. The first module fingers extend from the passage panel. The ground tab extends from at least one of the passage panel or one of the first module fingers.

In some embodiments, the ground tab is a first ground tab and the cage cover includes a second ground tab that engages the inner surface of the receptacle cage and extends lengthwise along the Y-axis toward the first ground tab. Optionally, the first and second ground tabs engage the inner surface of the receptacle cage along corresponding linear engagement zones that extend generally parallel to the Z-axis.

Optionally, the cage cover also includes a side tab that extends lengthwise in the loading direction. The ground tab engages the inner surface of the receptacle cage at an engagement zone that has an elevation relative to the Z-axis that is between elevations of the first and second linear engagement zones.

Optionally, the engagement zones of the first and second ground tabs and the engagement zone of the side tab have an I-shaped relationship.

In particular embodiments, the first and second module passages are sized and shaped to receive the pluggable modules formed in accordance with a small-form factor standard. Optionally, the receptacle assembly may also include an electrical connector disposed in the interior cavity that is configured to mate with the pluggable modules. The receptacle assembly may be capable of operating at 25 gigabits per second (Gbps).

In an embodiment, a communication system is provided that includes a circuit board and an electrical connector mounted to the circuit board. The electrical connector has a plurality of data ports configured to receive respective pluggable modules. The communication system also includes a receptacle assembly mounted to the circuit board.

The receptacle assembly may be similar or identical to one or more aspects of the above receptacle assembly. For example, the receptacle assembly may include a receptacle cage having an interior cavity and first and second partition walls disposed in the interior cavity that separate the interior cavity into first and second module passages, respectively. The receptacle cage includes at least one partition wall that divides the interior cavity into first and second module passages. The electrical connector is disposed within the interior cavity. The first and second module passages have first and second port openings, respectively, at a front end of the receptacle cage. The first and second module passages are configured to receive the respective pluggable modules through the first and second port openings in a loading direction that is parallel to a Z-axis. The receptacle assembly may also include a cage cover positioned at the front end between the first and second port openings. The cage cover includes first and second module fingers. The cage cover also includes a ground tab that engages an inner surface of the receptacle cage. The first and second module fingers extend lengthwise in the loading direction. The ground tab extend lengthwise along a Y-axis that is perpendicular to the Z-axis.

In an embodiment, a receptacle assembly is provided that includes a receptacle cage having an interior cavity that opens to a front end of the receptacle cage. The receptacle assembly also includes a cavity divider coupled to the receptacle cage and disposed within the interior cavity. The cavity divider separates the interior cavity into first and second module passages having first and second port openings, respectively, at the front end of the receptacle cage. The first and second module passages are configured to receive corresponding pluggable modules through the first and second port openings, respectively, in a loading direction that is parallel to a Z-axis. The cavity divider includes a face plate and first and second partition walls that are joined by the face plate. The face plate faces in a withdrawing direction that is opposite the loading direction. The first and second partition walls extend lengthwise in the loading direction from the face plate and define the first and second module passages, respectively, in the interior cavity. The cavity divider also includes a ground tab that is proximate to the face plate and engages an inner surface of the receptacle cage. The ground tab extends lengthwise along a Y-axis that is perpendicular to the Z-axis.

DETAILED DESCRIPTION

Embodiments set forth herein include receptacle assemblies and communication systems that include the same. The receptacle assemblies include a receptacle cage having a cage cover or cavity divider that separates adjacent port openings of the receptacle cage. Although the illustrated embodiment includes only two vertically-stacked port openings, it should be understood that embodiments may include more than two port openings. Additional port openings may be positioned horizontally with respect to the other port openings in alternative embodiments.

Embodiments may be particularly suitable for high speed applications. For example, embodiments described herein may include high-speed electrical connectors that are capable of transmitting data at a data rate of at least about five (5) gigabits per second (Gbps) per lane, at least about 10 Gbps per lane, at least about 25 Gbps per lane, at least about 50 Gbps per lane, or more.

Embodiments may be physically configured to sufficiently satisfy an industry standard. For example, the receptacle assemblies described herein may be physically configured (e.g., sized and shaped) to satisfy a small-form factor standard. Examples of small-form factor standards include small-form factor pluggable (SFP), enhanced SFP (SFP+), quad SFP (QSFP), high speed QSFP (or zQSFP), enhanced zQSFP (zQSFP+), microQSFP, C form-factor pluggable (CFP), and 10 Gigabit SFP, which is often referred to as XFP. A receptacle assembly that is configured to satisfy a small-form factor industry standard includes a receptacle cage having a plurality of elongated passages that are aligned with a respective data port of an electrical connector. Each passage is sized and shaped to receive a small-form factor pluggable module.

The receptacle assemblies and communication systems may be capable of implementing one or more communication protocols including, but not necessarily limited to, Ethernet, Fibre Channel, InfiniBand, and Synchronous Optical Networking (SONET)/Synchronous Digital Hierarchy (SDH). Pluggable modules may be configured to engage a communication cable and may be a direct attach copper (DAC) transceiver, an active optical cable (AOC) transceiver, or an optical transceiver (Txcvr).

It should be understood, however, that the benefits and advantages of the subject matter described and/or illustrated herein may accrue equally to other data transmission rates and/or across a variety of systems, standards, or protocols.

Figure 1:
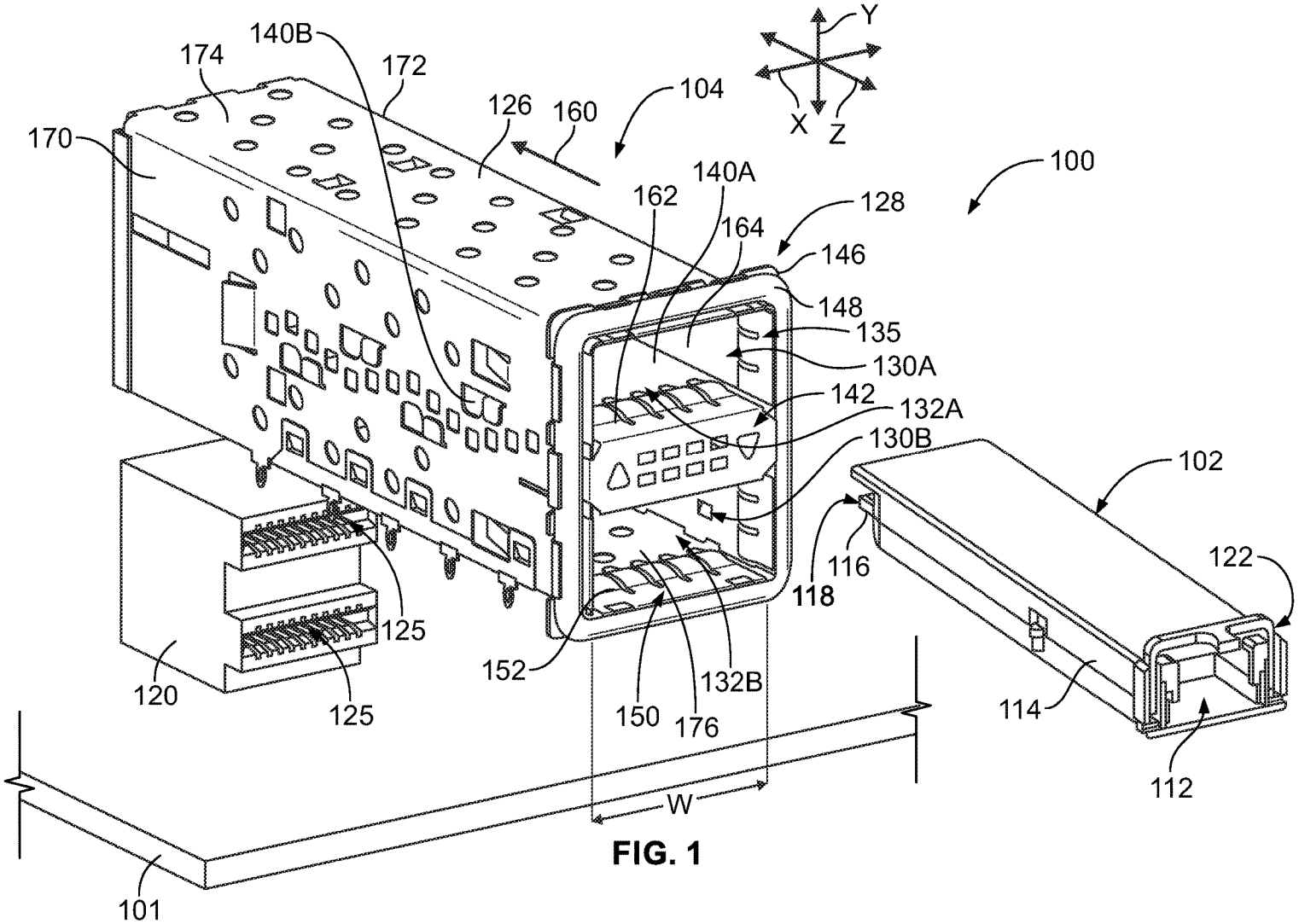
FIG. 1 is a front perspective view of a portion of a communication system in accordance with an embodiment that includes a receptacle assembly.

FIG. 1 is a partially exploded perspective view of an exemplary embodiment of a communication system 100. For reference, the communication system 100 is oriented with respect to mutually perpendicular X-, Y-, and Z-axes. As shown in FIG. 1, the Y-axis appears to extend parallel to a gravitational force direction. It should be understood, however, that the communication system 100 may have any orientation with respect to gravity.

The communication system 100 includes one or more pluggable modules 102 configured for pluggable insertion into a receptacle assembly 104 that is mounted on a circuit board 101 of the communication system 100. The circuit board 101 may be characterized as a host circuit board in some embodiments. The communication system 100 may be, for example, a router, a server system, a network system, and/or the like. The communication system 100 may include a conductive chassis (not shown) having a panel (not shown) including one or more panel openings (not shown) extending therethrough in substantial alignment with the receptacle assembly 104. The receptacle assembly 104 is optionally electrically connected to the panel. For clarity, only one pluggable module 102 and only one receptacle assembly 104 are shown in FIG. 1. It should be understood that the communication system 100 may include multiple pluggable modules 102 for each receptacle assembly 104 and may include multiple receptacle assemblies 104.

The pluggable module 102 is configured to be inserted into the receptacle assembly 104. Specifically, the pluggable module 102 is inserted into the receptacle assembly 104 through the panel opening (not shown) such that a trailing end 112 of the pluggable module 102 extends outwardly from the receptacle assembly 104. The pluggable module 102 includes a module housing 114 that forms a protective shell for a module board 116 that is disposed within the module housing 114. The module board 116 carries circuitry, traces, paths, devices, and/or the like that perform transceiver functions or operations. A leading edge 118 of the module board 116 is exposed for pluggable insertion into a respective data port 125 of an electrical connector 120 of the receptacle assembly 104.

In general, the pluggable modules 102 and the receptacle assembly 104 may be used in any application requiring an interface between a communication system and electrical and/or optical connectors. The communication system 100 may include host devices (not shown) (e.g., integrated circuits, processors, and the like) that are mounted to the circuit board 101 and in electrical communication with the electrical connector 120 of the receptacle assembly 104. For example, one host device may include an application specific integrated circuit (ASIC) that is configured to communicate with the electrical connector 120. The ASIC may constitute a serializer/deserializer (SerDes) interface.

Each pluggable module 102 interfaces to one or more optical cables (not shown) and/or one or more electrical cables (not shown) through a connector interface 122 at the trailing end 112. The electrical connector 120 is disposed within an electrically conductive receptacle cage 126 of the receptacle assembly 104. The electrical connector 120 and the receptacle cage 126 are configured to be mounted onto the circuit board 101. In the illustrated embodiment, the receptacle cage 126 is stamped and formed from sheet metal, but other fabrication methods are contemplated.

As illustrated in FIG. 1, the receptacle cage 126 includes a front end 128 having first and second port openings 130A, 130B. The first and second port openings 130A, 130B provide access to first and second module passages 132A, 132B, respectively. The first and second module passages 132A, 132B are elongated passages that are sized and shaped to receive the corresponding pluggable module 102. The first and second passages 132A, 132B are configured to receive respective pluggable modules 102 through the first and second port openings 130A, 130B, respectively, in a loading direction 160 that is parallel to the Z-axis. The front end 128 of the receptacle cage 126 is configured to be mounted, or received, within a panel opening (not shown). Each of the first and second module passages 132A, 132B has a corresponding data port 125 of the electrical connector 120 positioned at an end of the respective module passage. The data port 125 is configured to receive the leading edge 118 of the module board 116 of the corresponding pluggable module 102.

The receptacle cage 126 includes opposite side walls 170, 172 and a top wall 174 that extends between and joins the side walls 170, 172. The receptacle cage 126 may also include a bottom wall 176 that extends between and joins the side walls 170, 172. For embodiments that include the bottom wall 176, the bottom wall 176 has an opening (not shown) for receiving the electrical connector 120 therethrough.

The receptacle cage 126 has an interior cavity 135 and at least one partition wall that divides the interior cavity 135 into the first and second module passages 132A, 132B. In an exemplary embodiment, the receptacle cage 126 includes a first partition wall 140A that partially defines the first module passage 132A and a second partition wall 140B that partially defines the second module passage 132B. The first partition wall 140A and the second partition wall 140B extend parallel to each other. The receptacle assembly 104 also includes a cage cover 142 mounted to the partition walls 140A, 140B and/or the receptacle cage 126. The cage cover 142 is positioned at the front end 128 between the first and second port openings 130A, 130B. The cage cover 142 includes module fingers 162 disposed in the first and second module passages 132A, 132B. The module fingers 162 extend lengthwise in the loading direction 160.

The cage cover 142 also includes at least one ground tab (not shown) that engages an inner surface 164 of the receptacle cage 126. The ground tab(s) may be similar to or identical to ground tabs 206, 208 shown in FIG. 2. Each of the side walls 170, 172, the top wall 174, and the bottom wall 176 may have a portion of the inner surface 164. Each ground tab of the cage cover 142 may engage the inner surface 164 along the side wall 170 or the inner surface 164 along the side wall 172. In particular embodiments, the cage cover 142 is configured to reduce and/or contain EMI emissions generated within the receptacle cage 126 during operation. Optionally, the cage cover 142 may also be configured to hold one or more light pipes (not shown) and/or permit air to flow between the first and second module passages 132A, 132B to transfer thermal energy away from the partition walls 140A, 140B.

The receptacle assembly 104 may also include a bracket 146 and a gasket 148. The gasket 148 extends around the front end 128 of the receptacle cage 126 to facilitate reducing and/or containing EMI emissions. When the front end 128 of the receptacle cage 126 is mounted within the panel opening (not shown), the gasket 148 is sandwiched between the bracket 146 and the panel (not shown). Optionally, the gasket 148 is configured to be at least partially compressed between the bracket 146 and the panel. EMI gaskets 150 are mounted to the front end 128 of the receptacle cage 126. The EMI gaskets 150 include electrically conductive springs or fingers 152 that are positioned at or proximate to the port openings 130A, 130B and surround the first and second module passages 132A, 132B, respectively. The springs 152 are configured to engage the corresponding pluggable module 102 when the pluggable module 102 is positioned within the corresponding module passage of the receptacle cage 126. The springs 152, module fingers 162, and the ground tabs collectively operate to reduce and/or contain EMI emissions by providing a plurality of contact points that ground the pluggable module 102 to the receptacle cage 126.

Figure 2:
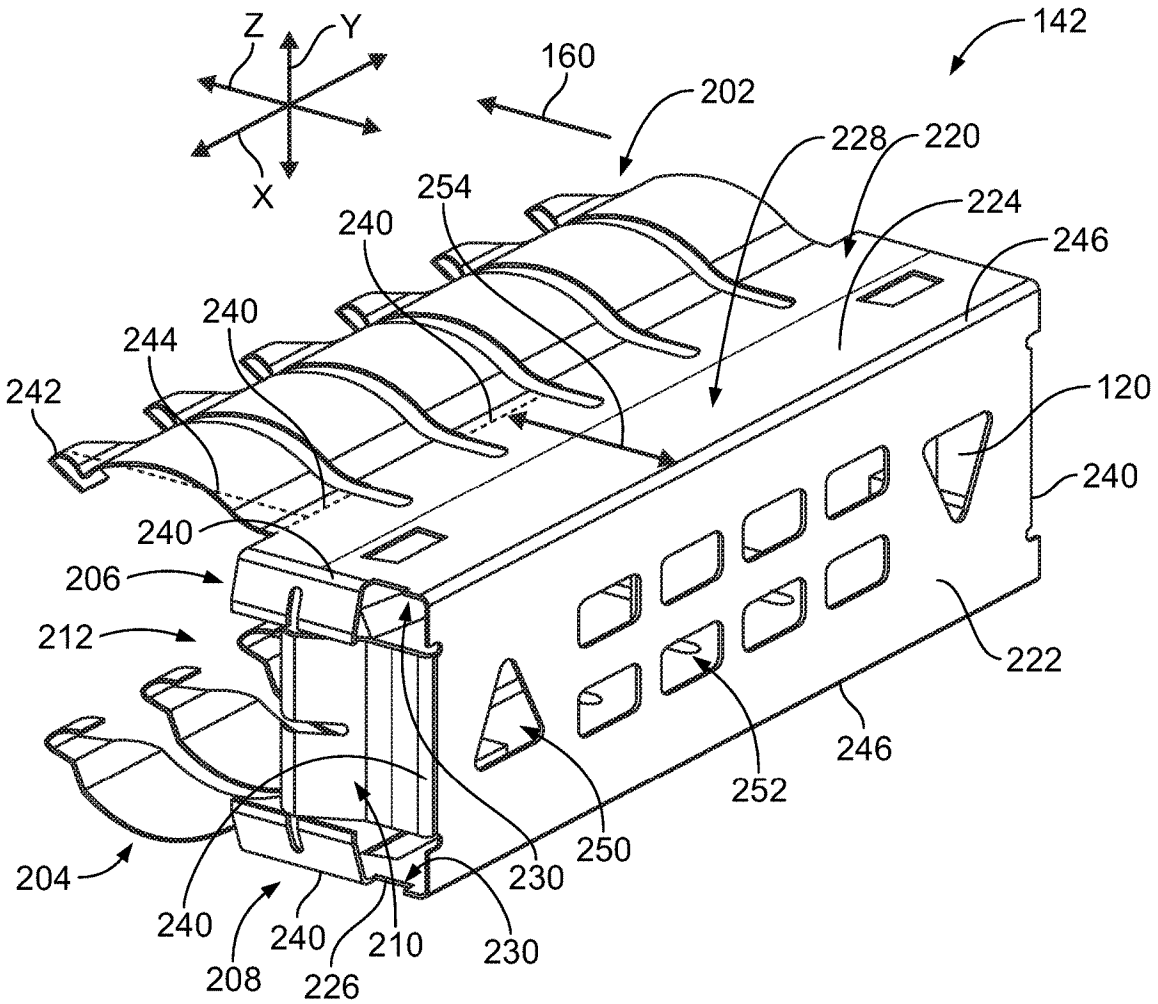
FIG. 2 is a perspective view of a cage cover that may be used with the receptacle assembly of FIG. 1.
Figure 3:
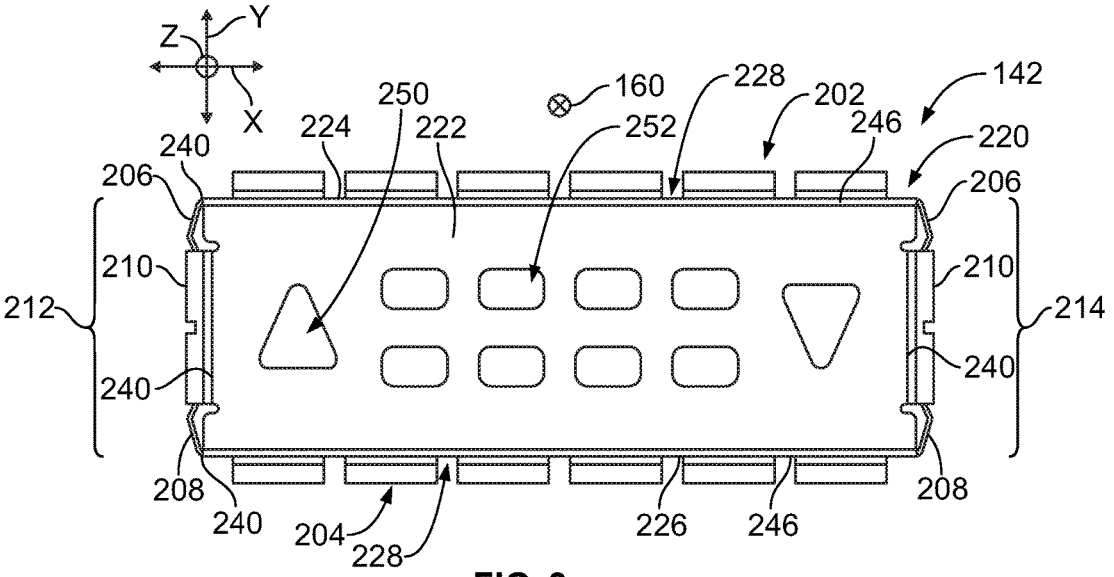
FIG. 3 is a front view of the cage cover that may be used with the receptacle assembly of FIG. 1.

FIG. 2 is a perspective view of the cage cover 142 in accordance with an embodiment. FIG. 3 is a front end view of the cage cover 142. For reference, the cage cover 142 is oriented with respect to the mutually perpendicular X-, Y-, and Z-axes. As described herein, the cage cover 142 may be coupled to a receptacle cage and positioned between adjacent port openings. The cage cover 142 may be configured to reduce EMI leakage and/or contain EMI within the receptacle cage.

In the illustrated embodiment, the cage cover 142 includes a plurality of first module fingers 202, a plurality of second module fingers 204, first ground tabs 206, second ground tabs 208, and side tabs 210. On one side of the cage cover 142, a multi-point ground assembly 212 is formed by a corresponding first ground tab 206, a corresponding second ground tab 208, and a corresponding side tab 210. On an opposite side of the cage cover 142, as shown in FIG. 3, a multi-point ground assembly 214 is formed by a corresponding first ground tab 206, a corresponding second ground tab 208, and a corresponding side tab 210. Each of the side tabs 210 is adjacent to one of the ground tabs 206 and one of the ground tabs 208. More specifically, no other tab exists between the side tab 210 and the corresponding ground tab. The side tab 210 is positioned proximate to the corresponding ground tab to reduce EMI leakage therebetween. Each of the side tabs 210 is positioned between the corresponding ground tab 206 and the corresponding ground tab 208.

FIGS. 2 and 3 illustrate an exemplary configuration of module fingers, ground tabs, and side tabs. It should be understood, however, that the cage cover 142 may include a different combination and/or arrangement of module fingers, ground tabs, and side tabs in other embodiments. For example, in an alternative embodiment, the cage cover 142 may include only a single first module finger 202, only a single second module finger 204, and only a single ground tab 206. In an alternative embodiment, the cage cover 142 only includes one multi-point ground assembly.

As shown in FIGS. 2 and 3, the cage cover 142 includes a base structure 220. The ground tabs 206, 208 are coupled to and configured to flex with respect to the base structure 220. The base structure 220 includes a face plate 222 and passage panels 224, 226 that are coupled to the face plate 222. The passage panels 224, 226 may be referred to as first and second passage panels 224, 226, respectively, in some embodiments. The face plate 222 is configured to face an exterior of the receptacle assembly 104 (FIG. 1) in a direction along the Z-axis that is opposite the loading direction 160. The passage panels 224, 226 are coupled to the face plate 222 and oriented perpendicular to the face plate 222. The face plate 222 includes a plurality of status apertures 250, 252. The status apertures 250, 252 may align with light pipes (not shown) of the receptacle assembly 104. Light that propagates through the light pipes may be emitted through the status apertures 250, 252 to indicate a status of the pluggable module and/or communication system 100 (FIG. 1).

The passage panel 224 is configured to partially define the first module passage 132A (FIG. 1), and the passage panel 226 is configured to partially define the second module passage 132B (FIG. 1). Each of the passage panels 224, 226 includes a module-side surface 228 and a wall-side surface 230 (FIG. 2). Each module-side surface 228 is configured to interface with the pluggable module 102 (FIG. 1) when the pluggable module 102 is positioned in the corresponding module passage. Each wall-side surface 230 is configured to interface with one of the partition walls. For example, when the cage cover 142 is coupled to the receptacle cage 126, the passage panel 224 is disposed within the first module passage 132A and may interface with the partition wall 140A (FIG. 1) along the wall-side surface 230, and the passage panel 226 is disposed within the second module passage 132B and may interface with the partition wall 140B (FIG. 1) along the wall-side surface 230. In some embodiments, the passage panels 224, 226 may grip the partition walls 140A, 140B therebetween.

Each module finger, ground tab, and wall tab extends lengthwise from a proximal joint to a distal end. For example, as shown in FIG. 2, each of the first module fingers 202 extends from a proximal joint 240 (indicated by dashed line that extends parallel to the X-axis) to a distal end 242. Each proximal joint 240 may represent a localized region that the first module finger partially flexes or rotates about when deflected by the pluggable module 102 (FIG. 1) or when disengaged from the pluggable module 102 (FIG. 1). Each proximal joint of the module fingers occurs where the corresponding module finger begins to change in elevation along the Y-axis relative to the corresponding passage panel. For example, as the module fingers 202 extend away from the passage panel 224 along the Z-axis, the proximal joints 240 occur where the corresponding module finger 202 begins to curve upward along the Y-axis. The distal end 242 represents a surface of the first module finger 202 that is furthest from the base structure 220, the face plate 222, or the corresponding passage panel 224. It should be understood that a length of an element (e.g., module finger, ground tab, or side tab) is not necessarily the greatest dimension of the element. For example, each of the ground tabs 206, 208 may have a width measured along the Z-axis that is greater than a length that is measured substantially along the Y-axis. Each of the first and second module fingers 202, 204, however, may have a width measured along the X-axis that is less than a length that is measured substantially along the Z-axis.

As used herein, a module finger, a ground tab, and/or a side tab "extends lengthwise in a [designated] direction" if a line drawn from the proximal joint to the distal end extends generally parallel to the designated direction. By way of example, a line 244 is shown in FIG. 2 that extends from the proximal joint 240 to the distal end 242 of one of the first module fingers 202. The line 244 extends generally parallel (e.g., +/−30°) to the loading direction 160 and the Z-axis. It is also noted that, when the first module fingers 202 are compressed between the corresponding partition wall 140A (FIG. 1) and the pluggable module 102 (FIG. 1), the first module fingers 202 extend generally parallel to the loading direction 160 and the Z-axis.

In the illustrated embodiment, the first and second module fingers 202, 204 extend from the passage panels 224, 226, respectively. The passage panels 224, 226 may have a base dimension or distance 254 (FIG. 2) that is measured from the face plate 222 to a corresponding proximal joint 240 along the Z-axis. The base dimension 254 may essentially correspond to a depth within the respective module passage. In other embodiments, the cage cover 142 may be devoid of passage panels such that the first and second module fingers 202, 204 may extend directly from the face plate 222. In such embodiments, the ground tabs 206, 208 may extend from one of the module fingers.

The first and second module fingers 202, 204 extend lengthwise in the loading direction 160. The first and second module fingers 202, 204 are coupled to and configured to flex with respect to the base structure 220. The side tabs 210 extend lengthwise in the loading direction 160. The ground tabs 206, 208, however, extend lengthwise along the Y-axis. The ground tabs 206, 208 may extend toward each other. As shown, the ground tabs 206, 208 extend from the passage panels 224, 226, respectively. It is contemplated, however, that the ground tabs 206, 208 may extend from corresponding first and second module fingers 202, 204. Yet in other embodiments, a section of the ground tab may align with and extend from a module finger and another section of the ground tab may extend from the passage panel. As such, a ground tab may extend from at least one of the passage panel or the module finger.

When the receptacle assembly 104 (FIG. 1) is fully constructed and operable, each of the ground tabs 206, 208 and each of the side tabs 210 engages an inner surface of the receptacle cage 126 (FIG. 1), such as the inner surface 164 (FIG. 1). The first and second module fingers 202, 204 are configured to be disposed in the first and second module passages 132A, 132B (FIG. 1). The first and second module fingers 202, 204 are positioned for engaging an exterior surface of the pluggable modules. As described below, two surfaces may engage each other at an engagement zone. Embodiments set forth herein may include a plurality of engagement zones that are positioned relative to one another to reduce EMI leakage and/or contain the EMI emissions.

In the illustrated embodiment, the cage cover 142 is stamped and formed from a single section of sheet material (e.g., metal). For example, a working blank may be stamped from sheet metal. The first module fingers 202 and the second module fingers 204 may be shaped to have a curved contour as shown in FIG. 2. The passage panels 224, 226 may be folded relative to the face plate 222 along respective corners 246, and the side tabs 210 may be folded along respective proximal joints 240. Before, after, or during the folding of the passage panels 224, 226 and the side tabs 210, the ground tabs 206, 208 may be folded along respective proximal joints 240. When operably formed, the passage panels 224, 226 and the side tabs 210 are oriented to extend generally along the Z-axis, and the ground tabs 206, 208 are oriented to extend generally along the Y-axis.

Figure 4:
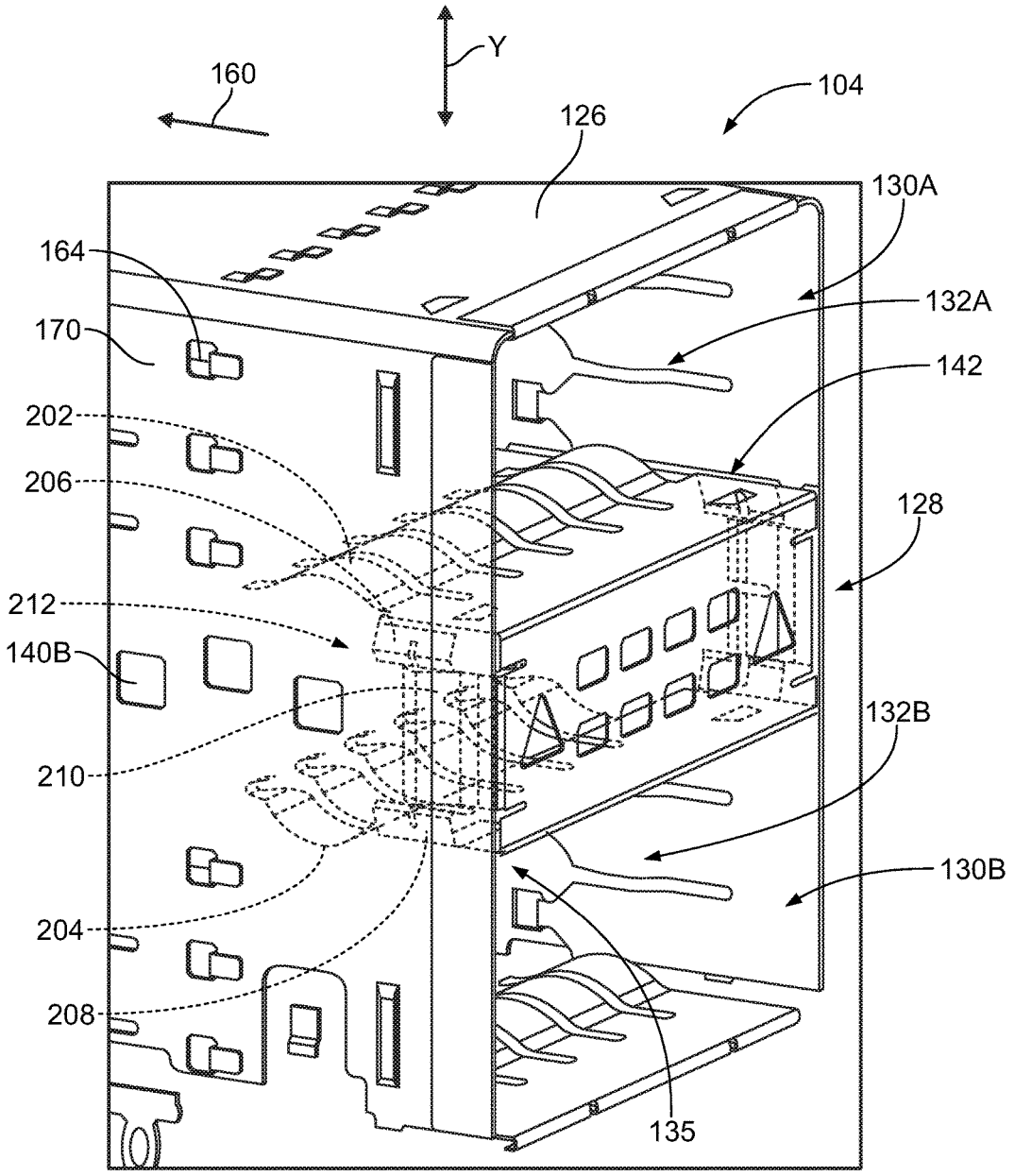
FIG. 4 is a perspective view of a portion of a receptacle assembly that includes the cage cover of FIG. 2.

FIG. 4 is a perspective view of a portion of the receptacle assembly 104 having the cage cover 142 positioned between first and second port openings 130A, 130B. A portion of the cage cover 142 that is disposed within the interior cavity 135 is shown in phantom. The cage cover 142 is positioned at the front end 128 of the receptacle cage 126 between the first and second port openings 130A, 130B. The first and second module fingers 202, 204 are disposed in the first and second module passages 132A, 132B, respectively. The ground tabs 206, 208 and the side tab 210 of the multi-point ground assembly 212 engage the inner surface 164 of the side wall 170. The first and second module fingers 202, 204 extend lengthwise in the loading direction 160. The ground tabs 206, 208 extend lengthwise along the Y-axis.

Figure 5:
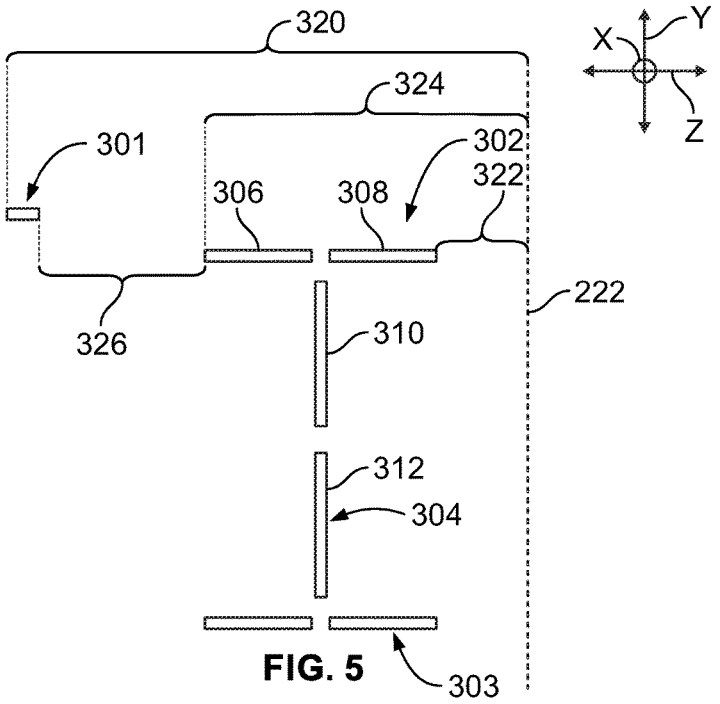
FIG. 5 illustrates a plurality of engagement zones in accordance with an embodiment.

FIG. 5 illustrates a plurality of engagement zones 301, 302, 303, 304 that are formed between the pluggable module 102 (FIG. 1) and the first module fingers 202 (FIG. 2) and between the receptacle cage 126 (FIG. 1) and the multi-point ground assembly 212 (FIG. 2). Engagement zones between a corresponding pluggable module 102 and the second module fingers 204 (FIG. 2) are not shown.

In the illustrated embodiment, each of the engagement zones 301-304 is a thin linear interface between two conductive elements. As such, the engagement zones 301-304 may be referred to as linear engagement zones. The engagement zones 301 extend into the page along the X-axis. As such, only one engagement zone 301 is shown in FIG. 5. The engagement zones 301 are formed between the first module fingers 202 (FIG. 2) and the pluggable module 102 (FIG. 1). The engagement zones 302, 303 extend parallel to the Z-axis and are formed between the ground tabs 206, 208, respectively, and the inner surface 164 (FIG. 1). The engagement zone 304 extends parallel to the Y-axis and is formed between the side tab 210 (FIG. 1) and the inner surface 164. As such, the engagement zones 302-304 may occur along a common surface. The engagement zones 302-304 may be coplanar, but the engagement zones 301 occur at different locations along the X-axis. Also shown, each of the engagement zones 302, 303 has two sub-zones 306, 308 that correspond to separate portions of the corresponding ground tab. The engagement zone 304 has two sub-zones 310, 312 that correspond to separate portions of the side tab 210.

In the illustrated embodiment, the engagement zones 301 occur at a module depth 320. The module depth 320 is measured along the Z-axis from the face plate 222 (represented by a dashed line) to the engagement zones 301. The engagement zones 302, 303 begin at a first wall depth 322 and end at a second wall depth 324, which is greater than the first wall depth 322. The second wall depth 324 is less than the module depth 320 by a Z-distance or gap 326. Without the engagement zones 302, 303, the Z-distance 326 would be measured between the engagement zones 301 and the engagement zone 304. As such, the Z-distance would be greater and possibly permit greater EMI leakage. The Z-distance 326 can be further decreased by moving the ground tabs 206, 208 deeper into the corresponding module passage. In such embodiments, the ground tabs 206 may extend from both the passage panel 224 (FIG. 2) and the first module finger 202 (FIG. 2) or from only the first module finger 202.

The engagement zones 301-304 may have an elevation (or elevation range) that is measured with respect to the Z-axis. For example, the engagement zones 302, 303 have different elevations with respect to each other and with respect to the engagement zone 304. The engagement zone 304 is positioned between the engagement zones 302, 303. As shown, the engagement zone 302 and the engagement zone 304 are linear engagement zones that extend in perpendicular directions. More specifically, the engagement zone 302 and the engagement zone 304 have a T-shaped relationship. The engagement zones 302, 303 and the engagement zone 304 have an I-shaped relationship.

Figure 6:
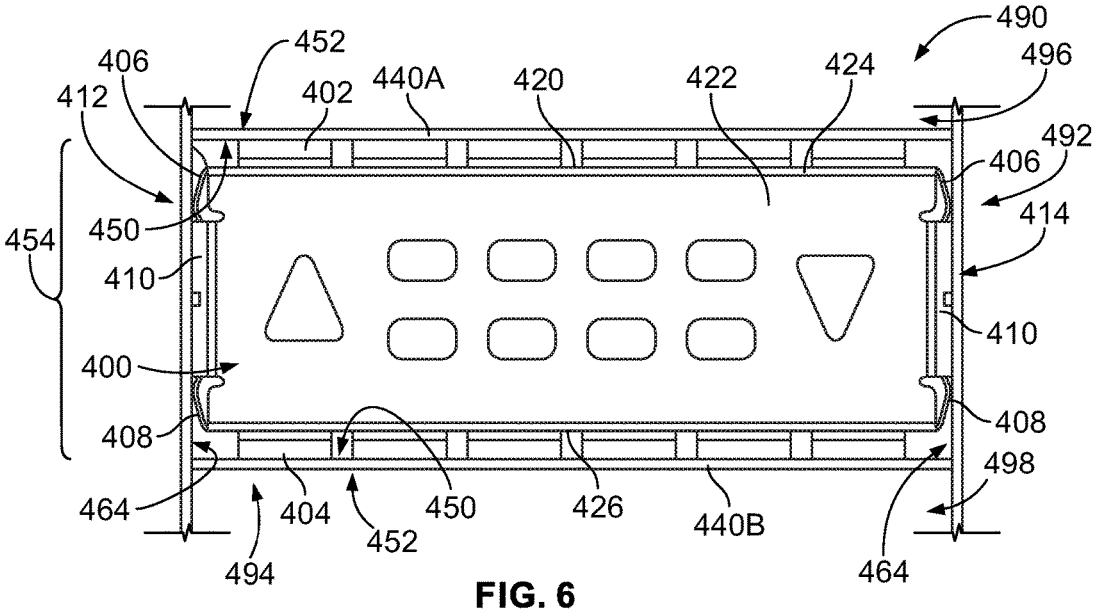
FIG. 6 is a front view of a cage cover formed in accordance with an embodiment.

FIG. 6 is a front view of a portion of a receptacle assembly 490 that includes a receptacle cage 492 and a cage cover 400. The receptacle assembly 490 is similar to the receptacle assembly 104 (FIG. 1) and may include similar or identical elements. For example, the receptacle assembly 490 includes first and second partition walls 440A, 440B that are disposed within an interior cavity 494 of the receptacle cage 492. The first and second partition walls 440A, 440B separate the interior cavity 494 into first and second module passages 496, 498 and a module gap 454. The cage cover 400 may be similar or identical to the cage cover 142 (FIG. 1). The cage cover 400 is generally positioned between the first and second partition walls 440A, 440B within the module gap 454.

In the illustrated embodiment, the cage cover 400 includes a plurality of first module fingers 402, a plurality of second module fingers 404, first ground tabs 406, second ground tabs 408, and side tabs 410. On one side of the cage cover 400, a multi-point ground assembly 412 is formed by a corresponding first ground tab 406, a corresponding second ground tab 408, and a corresponding side tab 410. On an opposite side of the cage cover 200, a multi-point ground assembly 414 is formed by a corresponding first ground tab 406, a corresponding second ground tab 408, and a corresponding side tab 410. The multi-point ground assemblies 412, 414 may be identical to the multi-point ground assemblies 212, 214 (FIG. 2).

As shown, the cage cover 400 includes a base structure 420. The ground tabs 406, 408 are coupled to and configured to flex with respect to the base structure 420. The base structure 420 includes a face plate 422 and passage panels 424, 426 that are coupled to the face plate 422. The passage panels 424, 426 may be referred to as first and second passage panels 424, 426, respectively, in some embodiments. The face plate 422 is configured to face an exterior of the receptacle assembly 104 (FIG. 1). The passage panels 424, 426 are coupled to the face plate 422 and oriented perpendicular to the face plate 422.

Each of the partition walls 440A, 440B includes a gap side 450 and an opposite module side 452. The gap sides 450 of the partition walls 440A, 440B define a module gap 454 therebetween. The cap cover 400 is positioned generally between the partition walls 440A, 440B within the module gap 454. Unlike the module fingers 202, 204 (FIG. 2), which each engage the module side of the corresponding partition wall, each of the module fingers 402, 404 is configured to engage the gap side 450 of the corresponding partition wall. More specifically, the module finger 402 engages the gap side 450 of the partition wall 440A, and the module finger 404 engages the gap side 450 of the partition wall 440B. The module side 452 of the partition wall 440A defines the module passage 496. The module side 452 of the partition wall 440B defines the module passage 498. As shown, each of the ground tabs 406, 408 and the side tabs 410 engage an inner surface 464 of the receptacle cage 492.

Figure 7:
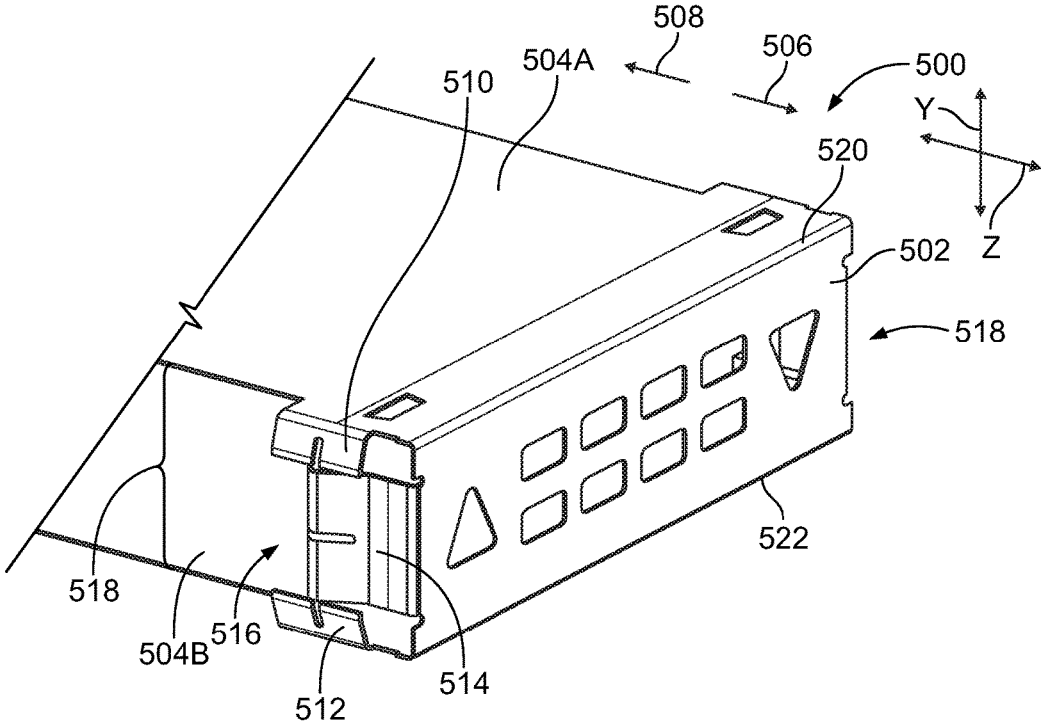
FIG. 7 is a perspective view of a cavity divider formed in accordance with an embodiment.

FIG. 7 is a perspective view of a cavity divider 500 in accordance with an embodiment. The cavity divider 500 may be disposed within an interior cavity (not shown) of a receptacle cage (not shown). The receptacle cage may be similar or identical to the receptacle cages 126 (FIG. 1) or 492 (FIG. 6). The cavity divider 500 may include elements that are similar to the cap covers and partition walls set forth herein. For example, the cavity divider 500 includes a face plate 502 and first and second partition walls 504A, 504B that are joined by the face plate 502. The partition walls 504A, 504B couple to the face plate 502 at fold lines 520, 522, respectively, which function as proximal joints in FIG. 7. The face plate 502 faces in a withdrawing direction 506 that is opposite a loading direction 508. The withdrawing and loading directions 506, 508 face in opposite directions along a Z-axis.

The first and second partition walls 504A, 504B extend lengthwise in the loading direction 508 from the face plate 522. The first and second partition walls 504A, 504B extend parallel to one another and define a module gap or space 518 therebetween. The first and second partition walls 504A, 504B are configured to define first and second module passages (not shown), respectively, in the interior cavity (not shown) of the receptacle cage. The first and second module passages may be similar to the first and second module passages 132A, 132B (FIG. 1).

In the illustrated embodiment, the cavity divider 500 includes ground tabs 510, 512 that are proximate to the face plate 502 (e.g., within 10 or 5 millimeters (mm)) and a side tab 514 that extends from the face plate 502. The ground tabs 510, 512 and the side tab 514 are configured to engage a common inner surface (not shown) of the receptacle cage. Similar to other ground tabs described herein, each of the ground tabs 510, 512 extends lengthwise along a Y-axis that is perpendicular to the Z-axis. The ground tabs 510, 512 and the side tab 514 may form a multi-point ground assembly 516 that is similar to the multi-point ground assemblies set forth herein. The cavity divider 500 includes another multi-point ground assembly 518 on an opposite side of the face plate 502. As such, the cavity divider 500 may effectively combine a cap cover and a pair of partition walls that are similar to the cap covers and partition walls described herein.

Similar to the cage covers and partition walls set forth herein, the cavity divider 500 is configured to reduce and/or contain EMI emissions generated within the receptacle cage during operation. Optionally, the cavity divider may also be configured to hold one or more light pipes (not shown) and/or permit air to flow between the first and second module passages to transfer thermal energy away from the partition walls.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the various embodiments without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The patentable scope should, therefore, be determined with reference to the appended claims, along with the full scope of equivalents to which such claims are entitled.

As used in the description, the phrase "in an exemplary embodiment" and the like means that the described embodiment is just one example. The phrase is not intended to limit the inventive subject matter to that embodiment. Other embodiments of the inventive subject matter may not include the recited feature or structure. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112(f), unless and until such claim limitations expressly use the phrase "means for" followed by a statement of function void of further structure.

What is claimed is:

1. A receptacle assembly comprising:

a receptacle cage having an interior cavity and first and second partition walls disposed in the interior cavity that separate the interior cavity into first and second module passages, respectively, the first and second module passages having first and second port openings, respectively, at a front end of the receptacle cage, the first and second module passages configured to receive corresponding pluggable modules through the first and second port openings, respectively, in a loading direction that is parallel to a Z-axis; and a cage cover positioned at the front end between the first and second port openings, the cage cover including first and second module fingers that are configured to engage the first and second partition walls, respectively, the cage cover also including a ground tab that engages an inner surface of the receptacle cage, the first and second module fingers extending lengthwise in the loading direction, the ground tab extending lengthwise along a Y-axis that is perpendicular to the Z-axis.

2. The receptacle assembly of claim 1, wherein the cage cover also includes a side tab that extends lengthwise in the loading direction, the side tab engaging the inner surface of the receptacle cage.

3. The receptacle assembly of claim 2, wherein the ground tab engages the inner surface of the receptacle cage along a first engagement zone and the side tab engages the inner surface of the receptacle cage along a second engagement zone, the first and second engagement zones having different elevations measured along the Z-axis.

4. The receptacle assembly of claim 2, wherein the ground tab engages the inner surface of the receptacle cage along a first engagement zone and the side tab engages the inner surface of the receptacle cage along a second engagement zone, the first and second engagement zones being linear engagement zones that extend lengthwise in perpendicular directions.

5. The receptacle assembly of claim 4, wherein the first and second engagement zones have a T-shaped relationship.

6. The receptacle assembly of claim 2, wherein the ground tab engages the inner surface of the receptacle cage along an engagement zone, the first and second module fingers configured to engage the respective pluggable modules along corresponding engagement zones, wherein the corresponding engagement zones of the first and second module fingers are located deeper with respect to the front end than the engagement zone of the ground tab.

7. The receptacle assembly of claim 1, wherein the cage cover includes a base structure having a face plate that faces an exterior of the receptacle assembly, the first and second module fingers being coupled to and configured to flex with respect to the base structure.

8. The receptacle assembly of claim 7, wherein the base structure includes a passage panel that is coupled to and oriented perpendicular to the face plate, the passage panel partially defining the first module passage, the first module fingers extending from the passage panel, the ground tab extending from at least one of the passage panel or one of the first module fingers.

9. The receptacle assembly of claim 1, wherein the ground tab is a first ground tab and the cage cover includes a second ground tab that engages the inner surface of the receptacle cage and extends lengthwise along the Y-axis toward the first ground tab.

10. The receptacle assembly of claim 9, wherein the first and second ground tabs engage the inner surface of the receptacle cage along corresponding linear engagement zones that extend generally parallel to the Z-axis.

11. The receptacle assembly of claim 10, wherein the cage cover also includes a side tab that extends lengthwise in the loading direction, the side tab engaging the inner surface of the receptacle cage at an engagement zone that has an elevation relative to the Z-axis that is between elevations of the first and second linear engagement zones.

12. The receptacle assembly of claim 10, wherein the engagement zones of the first and second ground tabs and the engagement zone of the side tab have an I-shaped relationship.

13. The receptacle assembly of claim 1, wherein the first and second module passages are sized and shaped to receive the pluggable modules formed in accordance with a small-form factor standard, the receptacle assembly further comprising an electrical connector configured to mate with the pluggable modules, the receptacle assembly capable of operating at 25 gigabits per second (Gbps) per lane.

14. A communication system comprising:

a circuit board;

an electrical connector mounted to the circuit board, the electrical connector having a plurality of data ports configured to receive respective pluggable modules; and a receptacle assembly mounted to the circuit board, the receptacle assembly comprising:

a receptacle cage having an interior cavity and first and second partition walls that are disposed in the interior cavity and separate the interior cavity into first and second module passages, respectively, the electrical connector being disposed within the interior cavity, the first and second module passages having first and second port openings, respectively, at a front end of the receptacle cage, the first and second module passages configured to receive the corresponding pluggable modules through the first and second port openings, respectively, in a loading direction that is parallel to a Z-axis; and a cage cover positioned at the front end between the first and second port openings, the cage cover including first and second module fingers that are configured to engage the first and second partition walls, respectively, the cage cover also including a ground tab that engages an inner surface of the receptacle cage, the first and second module fingers extending lengthwise in the loading direction, the ground tab extending lengthwise along a Y-axis that is perpendicular to the Z-axis.

15. The communication system of claim 14, wherein the cage cover also includes a side tab that extends lengthwise in the loading direction, the side tab engaging the inner surface of the receptacle cage.

16. The communication system of claim 15, wherein the ground tab engages the inner surface of the receptacle cage along a first engagement zone and the side tab engages the inner surface of the receptacle cage along a second engagement zone, the first and second engagement zones having different elevations measured along the Z-axis.

17. The communication system of claim 15, wherein the ground tab engages the inner surface of the receptacle cage along a first engagement zone and the side tab engages the inner surface of the receptacle cage along a second engagement zone, the first and second engagement zones being linear engagement zones that extend lengthwise in perpendicular directions.

18. The communication system of claim 15, wherein the ground tab engages the inner surface of the receptacle cage along an engagement zone, the first and second module fingers having wiping surfaces that engage the respective pluggable modules along corresponding engagement zones, wherein the corresponding engagement zones of the first and second module fingers are located deeper with respect to the front end than the engagement zone of the ground tab.

19. A receptacle assembly comprising:

a receptacle cage having an interior cavity that opens to a front end of the receptacle cage; and a cavity divider coupled to the receptacle cage and disposed within the interior cavity, the cavity divider separating the interior cavity into first and second module passages having first and second port openings, respectively, at the front end of the receptacle cage, the first and second module passages configured to receive corresponding pluggable modules through the first and second port openings, respectively, in a loading direction that is parallel to a Z-axis;

wherein the cavity divider includes a face plate and first and second partition walls that are joined by the face plate, the face plate facing in a withdrawing direction that is opposite the loading direction, the first and second partition walls extending lengthwise in the loading direction from the face plate and defining the first and second module passages, respectively, in the interior cavity, the cavity divider also including a ground tab that is proximate to the face plate and engages an inner surface of the receptacle cage, the ground tab extending lengthwise along a Y-axis that is perpendicular to the Z-axis.

20. The receptacle assembly of claim 19, wherein the cavity divider also includes a side tab that extends lengthwise in the loading direction, the side tab engaging the inner surface of the receptacle cage.

* * * * *